US009011111B2

(12) United States Patent
Lesko

(10) Patent No.: US 9,011,111 B2
(45) Date of Patent: Apr. 21, 2015

(54) MUD PUMP

(76) Inventor: Gerald Lesko, Edmonton (CA)

( * ) Notice: Subject to any disclaimer, the term of this patent is extended or adjusted under 35 U.S.C. 154(b) by 826 days.

(21) Appl. No.: 13/090,652

(22) Filed: Apr. 20, 2011

(65) Prior Publication Data

US 2011/0286867 A1 Nov. 24, 2011

Related U.S. Application Data

(60) Provisional application No. 61/345,858, filed on May 18, 2010.

(51) Int. Cl.

| | |
|---|---|
| ***F04B 53/14*** | (2006.01) |
| ***F04B 15/02*** | (2006.01) |
| ***F04B 9/04*** | (2006.01) |
| ***F04B 53/16*** | (2006.01) |

(52) U.S. Cl.

CPC ..... *F04B 15/02* (2013.01); *F04B 53/146* (2013.01); *F04B 9/042* (2013.01); *F04B 53/16* (2013.01)

(58) Field of Classification Search

CPC ..... F04B 53/14; F04B 53/146; F04B 9/042; F04B 15/02; F04B 53/016

USPC ..... 417/568; 92/140

See application file for complete search history.

(56) References Cited

U.S. PATENT DOCUMENTS

| | | | | |
|---|---|---|---|---|
| 3,896,926 | A * | 7/1975 | Cuniberti | 198/402 |
| 4,512,291 | A * | 4/1985 | Kirk | 123/54.2 |
| 6,164,188 | A * | 12/2000 | Miser | 92/84 |
| 7,364,412 | B2 * | 4/2008 | Kugelev et al. | 417/454 |
| 2004/0244576 | A1 * | 12/2004 | Kugelev et al. | 92/144 |
| 2007/0007042 | A1 * | 1/2007 | Gard | 175/61 |

OTHER PUBLICATIONS

Gardner—Denver, Mud Pumps, PO-7 & PV-9 Six Cylinder Single-Acting Piston & Plunger, pp. 1876-1877, at least as early as 1975, Quincy, Illinois.

* cited by examiner

*Primary Examiner* — Charles Freay
*Assistant Examiner* — Philip Stimpert
(74) *Attorney, Agent, or Firm* — Scott T. Griggs; Griggs Bergen LLP

(57) ABSTRACT

A mud pump is provided that includes a pump shaft having substantially circular eccentric lobes. Each lobe is rotatably mounted in a connecting rod that, in turn, moves a slide in a horizontal and linearly manner. A piston rod is operatively couples a pump module to one or both sides of each slide frame and a pump module. As the pump shaft turns, each lobe causes the slide to move side to side. As the slide moves side to side, each piston rod operates a pump module whose outputs can be coupled to a common manifold.

28 Claims, 14 Drawing Sheets

MUD PUMP

PRIORITY STATEMENT & CROSS-REFERENCE TO RELATED APPLICATIONS

This application claims priority from U.S. Patent Application No. 61/345,858, entitled "Mud Pump" and filed on May 18, 2010, in the name of Gerald Lesko; which is hereby incorporated by reference for all purposes.

TECHNICAL FIELD OF THE INVENTION

The present disclosure is related to the field of pumps in general and, in particular, pumps used in pumping drilling mud or "mud pumps".

BACKGROUND OF THE INVENTION

It is known to use pumps to provide drilling mud under pressure in the drilling of wells. Pressurized drilling mud is delivered down a hollow drill string as the well is being drilled to carry away cuttings up the annulus surrounding the drill string to ground level. Such drilling operations are well known to those skilled in the art.

Prior art pumps can use a motor to turn a crankshaft or "pump shaft" to convert rotary motion to a reciprocating motion. The pump shaft moves a connecting rod coupled to a crosshead that moves within a fixed crosshead slide to provide this conversion. The crosshead is coupled to a "pony rod" that, in turn, is coupled to a piston rod that provides the pumping motion in a pump module, as well known to those skilled in the art.

The above-mentioned mechanical arrangement can be multiplied so that a multitude or plurality of pump modules can be operated from a single pump shaft. The outputs of each pump module can be coupled to a common manifold from which pressurized drilling mud can be provided to the drill string. By coupling the pump module outputs to a common manifold, the pulsing of the pressure of the drilling mud can be reduced or smoothed out, this being a problem well known to those skilled in the art. The disadvantage of this mechanical arrangement is the size and complexity of the components involved to provide a multi-module pump.

It is also known in the oil and gas industry to drill horizontal wells. These are wells that are initially drilled vertically and, with the use of directional drilling equipment as well known to those skilled in the art, the direction of drilled well becomes horizontal or parallel with the ground surface. It is known to drill horizontal wells 5000 to 7500 feet in length or more. To do so requires the use of "mud motors", motors that are powered by the delivery of highly pressurized drilling mud pumped through the drill string so as to enable the turning of the drill bit. It is also known that to drill such wells, drilling operators will use at least two or more conventional mud pumps powered by 1000 horsepower or more motors. Each mud pump is housed in its own pump house and occupies space at the drilling site. As each additional pump house increases the number of structures at a drilling site, the number of truckloads required to deliver the necessary equipment to a drilling site also increases. All this additional equipment and number of truckloads to deliver the equipment add cost to the drilling of the well.

It is, therefore, desirable to provide a pump that can convert rotary motion to reciprocating motion without having to use connecting rods, crossheads, crosshead slides and pony rods to reduce its size, complexity and cost to manufacture. It is also desirable to provide a mud pump that is compact in size but can deliver pressurized mud at a volume equivalent to two or more conventional mud pumps.

SUMMARY OF THE INVENTION

A pump is provided that comprises a pump shaft having at least one eccentric lobe that is substantially circular. A motor is used to provide the rotational power to the pump shaft. In one embodiment, the motor can be coupled directly to the pump shaft. In another embodiment, a transmission can be used between the motor and the pump shaft to reduce the angular speed of the rotational power provided to the pump shaft. In a representative embodiment, a one or two-stage gear transmission can be used. In a further embodiment, the motor can be a 3-phase AC motor controlled by a variable frequency drive mechanism to control the speed of the motor.

In one embodiment of the pump, the eccentric lobe can be rotatably disposed within a connecting rod having a substantially circular opening to receive the lobe at one end with the other end rotatably pinned to a slide configured to move in a horizontal and linear manner. In one embodiment, the slide can be slidably disposed within a pair of slide support plates that constrains the slide to move in a linearly and horizontal or side-to-side manner. In one embodiment, slide-bearing mechanisms can be disposed between the slide and the support plates so that the slide can move side-to-side with minimal friction. In a representative embodiment, the slide-bearing mechanism can further comprise means for adjusting a loading force on the slide-bearing mechanism against the slide so that the slide is further constrained to horizontal and linear movement.

As the lobe rotates within the connecting rod opening, the connecting rod slide can move up and down thereby moving the slide linearly and horizontally between the slide support plates. As the slide frame moves side to side, it can move a piston rod in and out to operate a pump module. By virtue of this configuration, the slide can have a piston rod operatively coupled to one or both opposing sides of the slide. Therefore, a single slide can operate one or two pump modules at the same time. In a further embodiment, the pump shaft can comprise a plurality of eccentric lobes thereby allowing a plurality of slides to be operated by the lobes and, hence, a plurality of pump modules to be operated from a single rotating pump shaft.

Broadly stated, in some embodiments, a mud pump is provided, comprising: a frame; at least one pump module disposed on the frame, the at least one pump module comprising an inlet port and an outlet port; a pump shaft rotatably disposed in the frame for receiving rotational power from a motor, the pump shaft having at least one substantially circular eccentric lobe disposed thereon, the centre of the at least one eccentric lobe displaced or offset from the longitudinal axis of the pump shaft; at least one slide disposed in the frame, the at least one slide operatively configured to move linearly side-to-side within the frame; at least one piston rod assembly operatively coupling the at least one slide to the at least one pump module; and a connecting rod comprising first and second ends operating coupling the pump shaft to the at least one slide, the first end rotatably disposed on the at least one eccentric lobe, the second end rotatably pinned to the at least one slide whereby rotation of the pump shaft causes the slide to move side-to-side that, in turn, causes the at least one piston rod assembly to operate the at least one pump module.

Broadly stated, in some embodiments, a mud pump is provided, comprising: a platform; a lattice frame disposed on the platform; at least one pump module disposed on the frame, the at least one pump module comprising an inlet port and an outlet port; a pump shaft rotatably disposed in the frame for receiving rotational power from a motor, the pump shaft having at least one substantially circular eccentric lobe disposed thereon, the centre of the at least one eccentric lobe displaced or offset from the longitudinal axis of the pump shaft; a motor operatively coupled to the pump shaft, the motor disposed on the platform; at least one slide disposed in the frame, the at least one slide operatively configured to move linearly side-to-side within the frame; at least one piston rod assembly operatively coupling the at least one slide to the at least one pump module; and a connecting rod comprising first and second ends operating coupling the pump shaft to the at least one slide, the first end rotatably disposed on the at least one eccentric lobe, the second end rotatably pinned to the at least one slide whereby rotation of the pump shaft causes the slide to move side-to-side that, in turn, causes the at least one piston rod assembly to operate the at least one pump module.

DETAILED DESCRIPTION OF THE INVENTION

Referring to FIGS. 1 to 13, one embodiment of a mud pump is illustrated. In this embodiment, mud pump 10 can comprise lattice frame 18 and pump modules 24 mounted thereon. Frame 18 can further comprise mounting tabs 14 for attaching mud pump 10 to a platform, to a skid or to a pump house.

Figure 1:
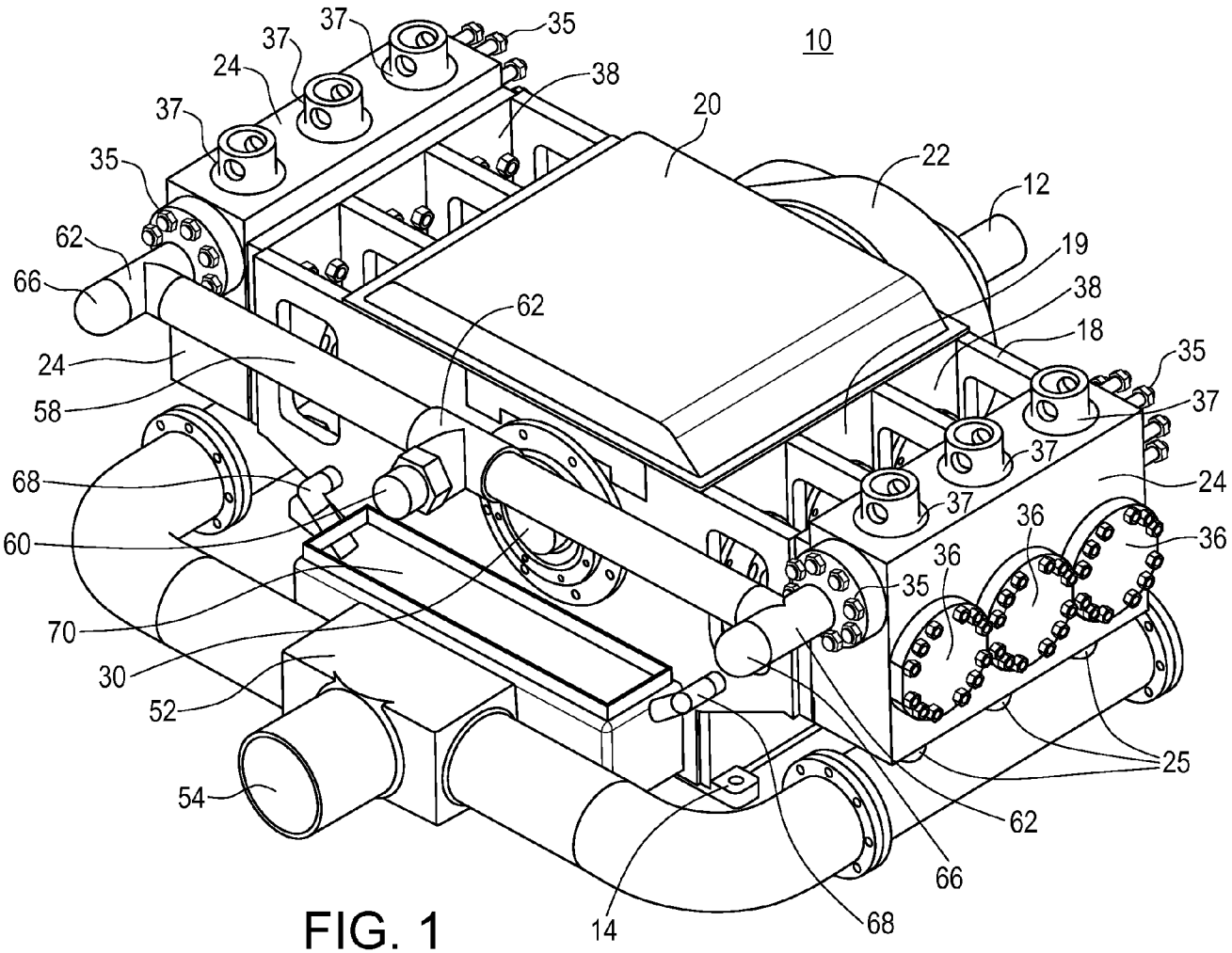
FIG. 1 is a rear perspective view depicting a mud pump having three slides, operating six pump modules in total.

For the purposes of this specification, and as shown specifically in the figures, each pump module 24 can comprise inlet port 25, outlet port 35, top access port 37 and side access port 36. Pump module 24, as illustrated, can be any suitable pump module that is readily available to the mud pump industry and is well known to those skilled in the art. As shown in FIG. 1, pump module 24 is shown as a singular device having three pump units disposed therein. It is obvious to those skilled in the art that pump module 24 can comprise one or more pump units use in combination. Representative examples of pump module 24 are pump modules having an 800 horsepower rating as manufactured by Continental Emsco in the U.S.A. or their equivalent. Such pumps have interchangeable liners of different diameters whereby the volume of mud handled by a pump module per pump cycle can be adjusted upwards or downwards depending on the diameter of the liner. Generally speaking, the smaller the volume per pump module, the greater the pressure the mud can be pumped at.

Referring to FIG. 1, mud pump 10 is shown having cover 20 disposed on top of lattice frame 18. Input shaft 12 can be connected to a motor (not shown) to provide rotational input power to mud pump 10. In some embodiments, an internal combustion motor can be used to provide rotational input power to mud pump 10. In other embodiments, an electric motor of suitable power rating can be used. In further embodiments, a variable frequency drive mechanism (not shown) as well known to those skilled in the art can be used to control the electrical power provided to the electric motor thereby controlling the rotational speed the motor operates at to supply rotational input power to mud pump 10.

In one embodiment, mud pump 10 can comprise transmission 22 to couple shaft 12 to the operating components of mud pump 10. Transmission 22 can be a single-stage or dual-stage gear transmission to reduce the rotational speed of input shaft 12 to the required rotational speed for proper operation of pump shaft 30 rotatably disposed in mud pump 10. In other embodiments, transmission 22 can comprise a planetary gear transmission. In further embodiments, transmission 22 can comprise helical gears. In yet other embodiments, transmission 22 can comprise spur gears. Intake manifold 52, comprising inlet 54, is shown attached to pump module inlet ports 25. Outlet manifold 58, comprising couplers 62 and end caps 66, is shown attached to pump module outlet ports 35. In one embodiment, frame 18 can comprise return lines 68 that provide communication from galleys 38 to reservoir 70. When in operation, lubricating oils are used to lubricate the moving components of mud pump 10. These oils will collect in galleys 38 and return to reservoir 70 through return lines 68 to be re-circulated through mud pump 10.

Figure 2:
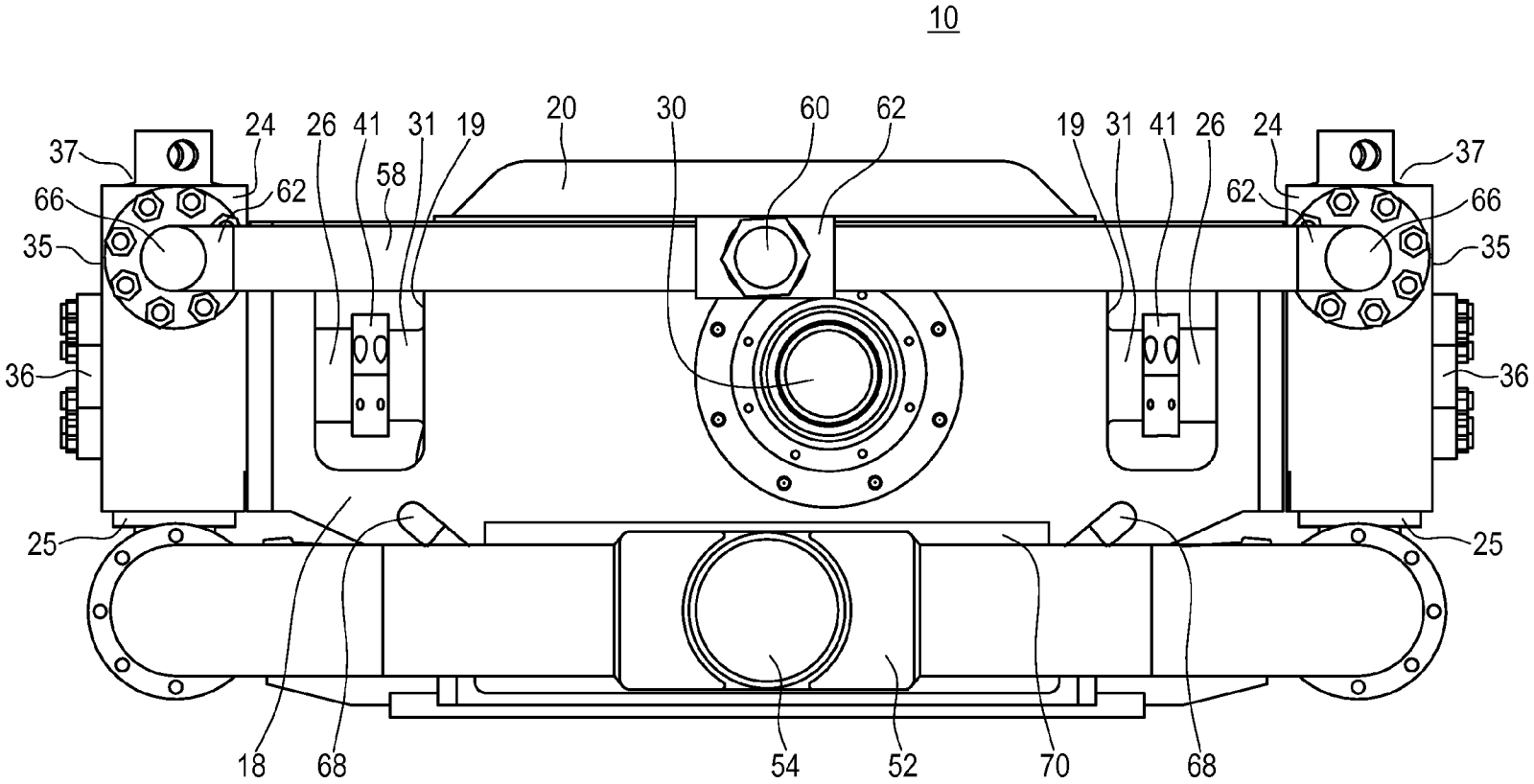
FIG. 2 is a rear elevation view depicting the mud pump of FIG. 1.

Referring to FIG. 2, a rear elevation view of mud pump 10 is shown. In this figure, piston rod support bushings 31 are shown disposed on sidewalls 19 of frame 18. Piston liners 26 are shown disposed between pump modules 24 and support bushings 31. Couplers 41 can be used to couple liners 26 to support bushings 31. As noted above, liners 26 can be comprised of various diameters depending on the volume and the pressure drilling mud is to be produced by mud pump 10.

Figure 3:
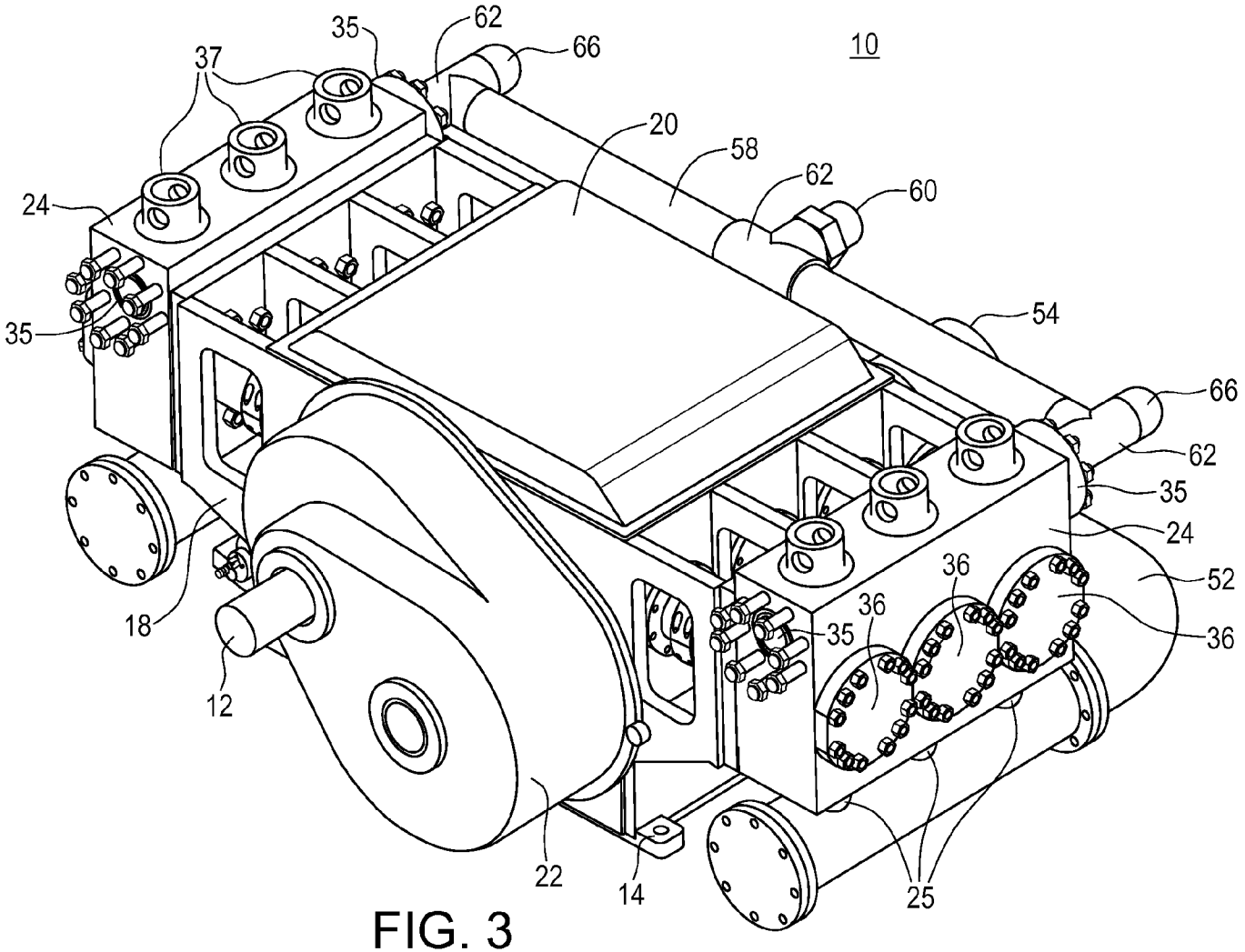
FIG. 3 is a front perspective view depicting the mud pump of FIG. 1.
Figure 4:
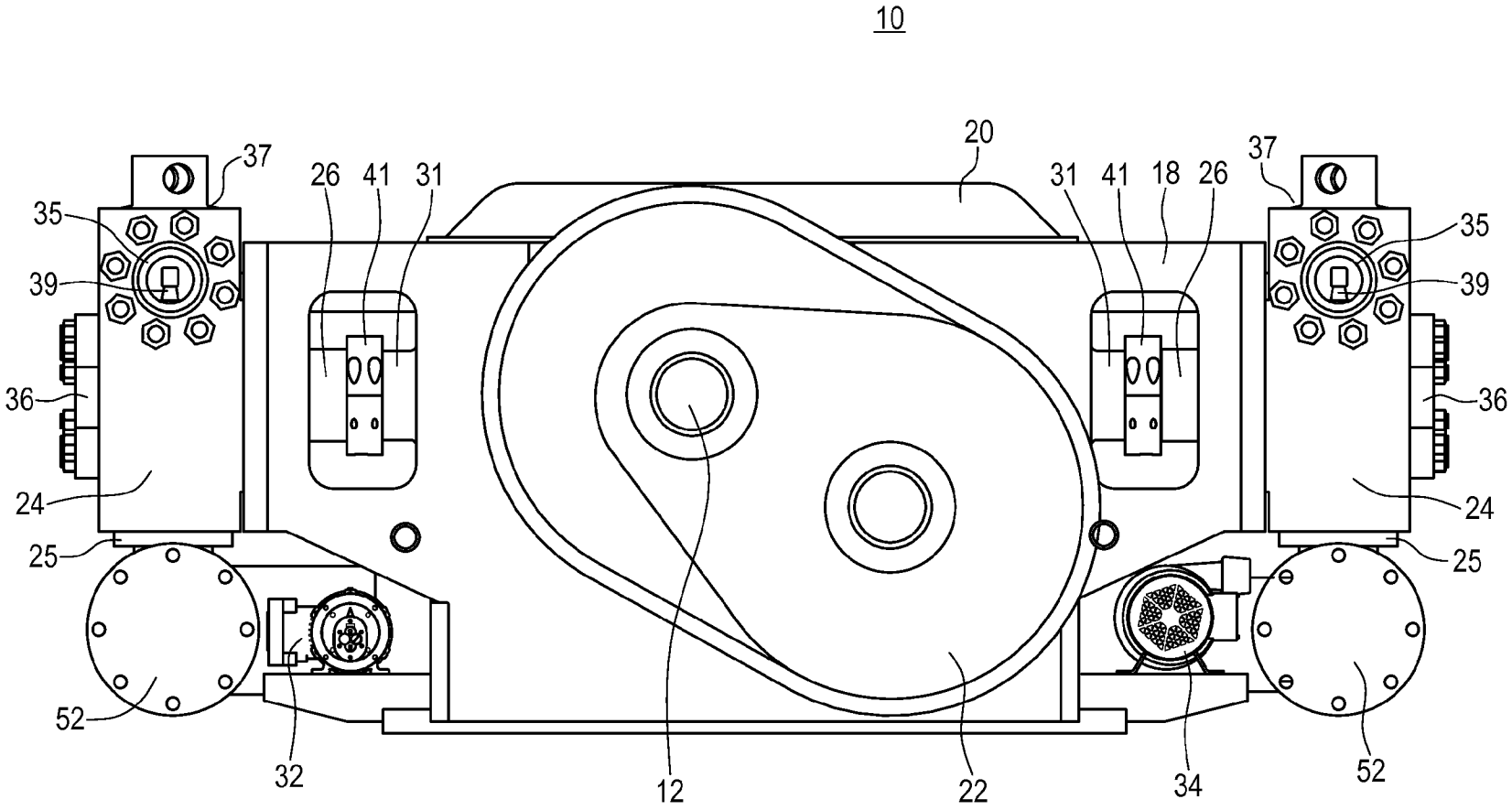
FIG. 4 is a front elevation view depicting the mud pump of FIG. 1.
Figure 13:
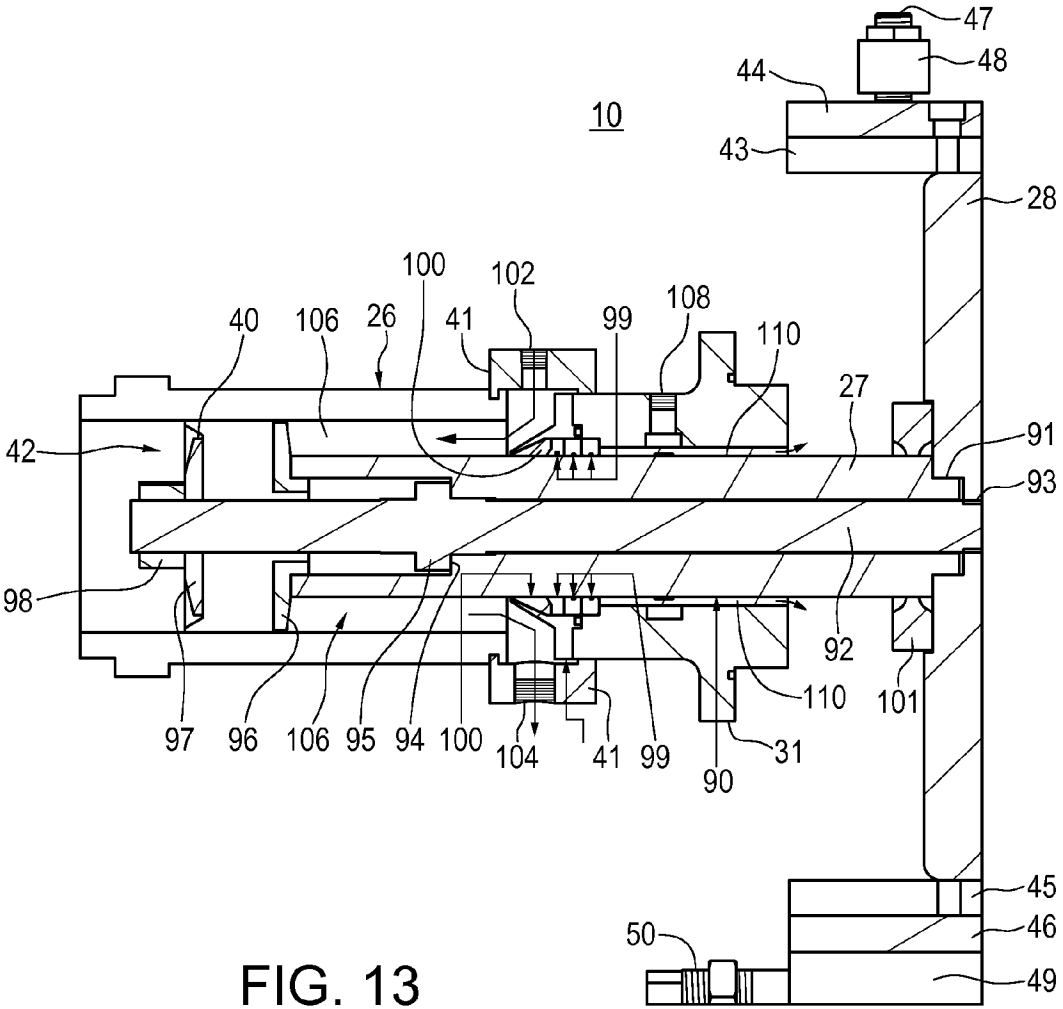
FIG. 13 is a front cross-sectional view depicting one piston rod/liner assembly of the mud pump of FIG. 10.

Referring to FIGS. 3 and 4, front views of mud pump 10 are shown. In this embodiment, pump modules 24 are shown with outlet ports 35 exposed having no output manifold attached thereon to show valve mechanism 39 disposed therein. In one embodiment, pump module 24 can comprise "sucker-cup" pump mechanisms as well known to those skilled in the art. In the illustrated embodiment, an output manifold (not shown) can be attached to the shown outlet ports 35 to collect drilling mud pumped by pump module 24, in addition to outlet manifold 58 shown in FIGS. 1 and 2, or it can be capped with a cover (not shown). Input ports 25 can be coupled together with intake manifold 52 that directs drilling mud into pump modules 24. In one embodiment, coolant pump 34 can be used to circulate coolant through piston liners 26 and oil pump 32 can be used to pump lubricating oil through support bushings 31 to lubricate the moving components therein, as described in more detail below and as shown in FIG. 13.

Figure 5:
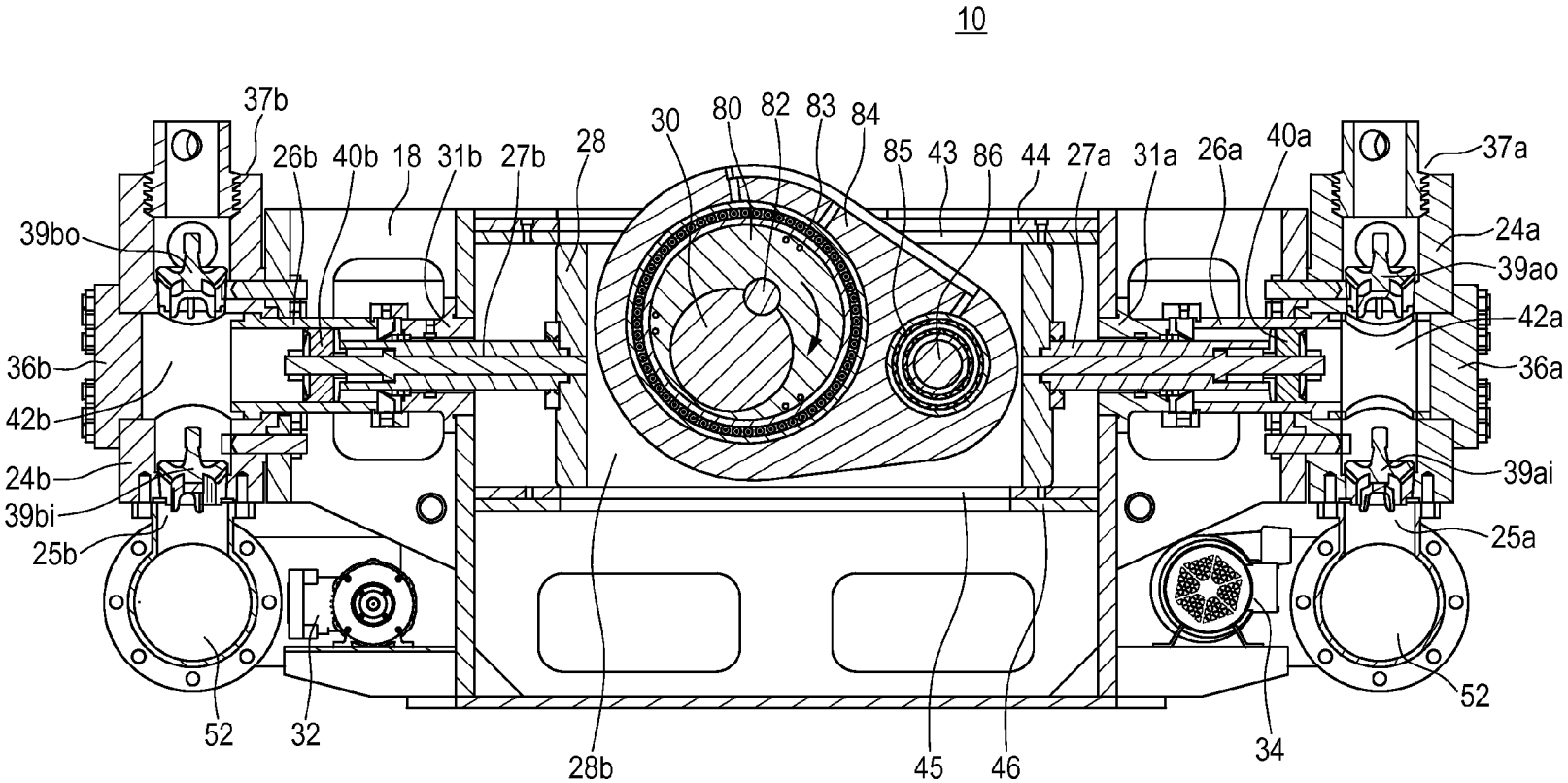
FIG. 5 is a front cross-sectional elevation view depicting the mud pump of FIG. 1 with the connecting rod moving upwards.
Figure 6:
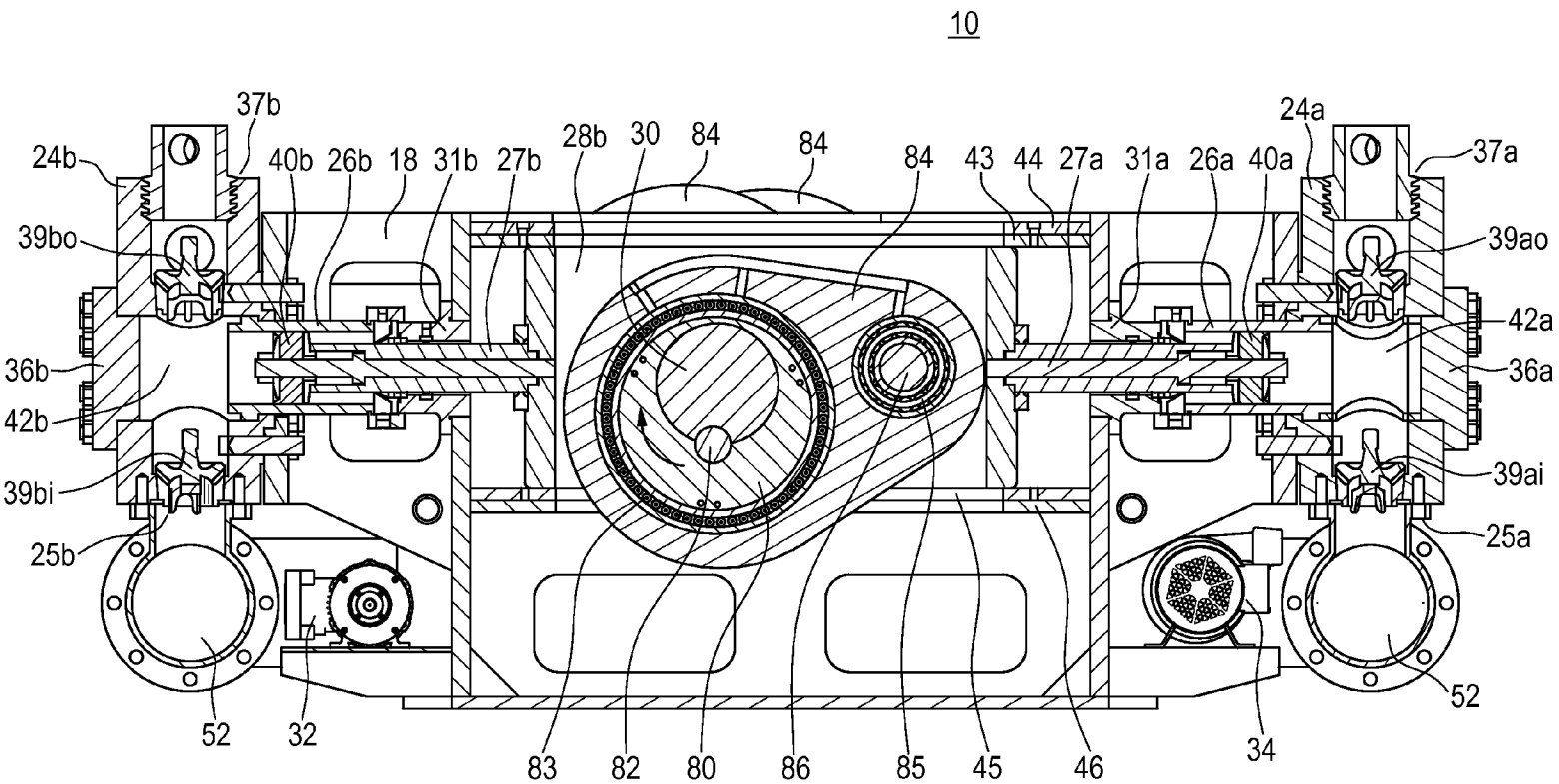
FIG. 6 is a front cross-sectional elevation view depicting the mud pump of FIG. 1 with the connecting rod moving downwards.
Figure 8:
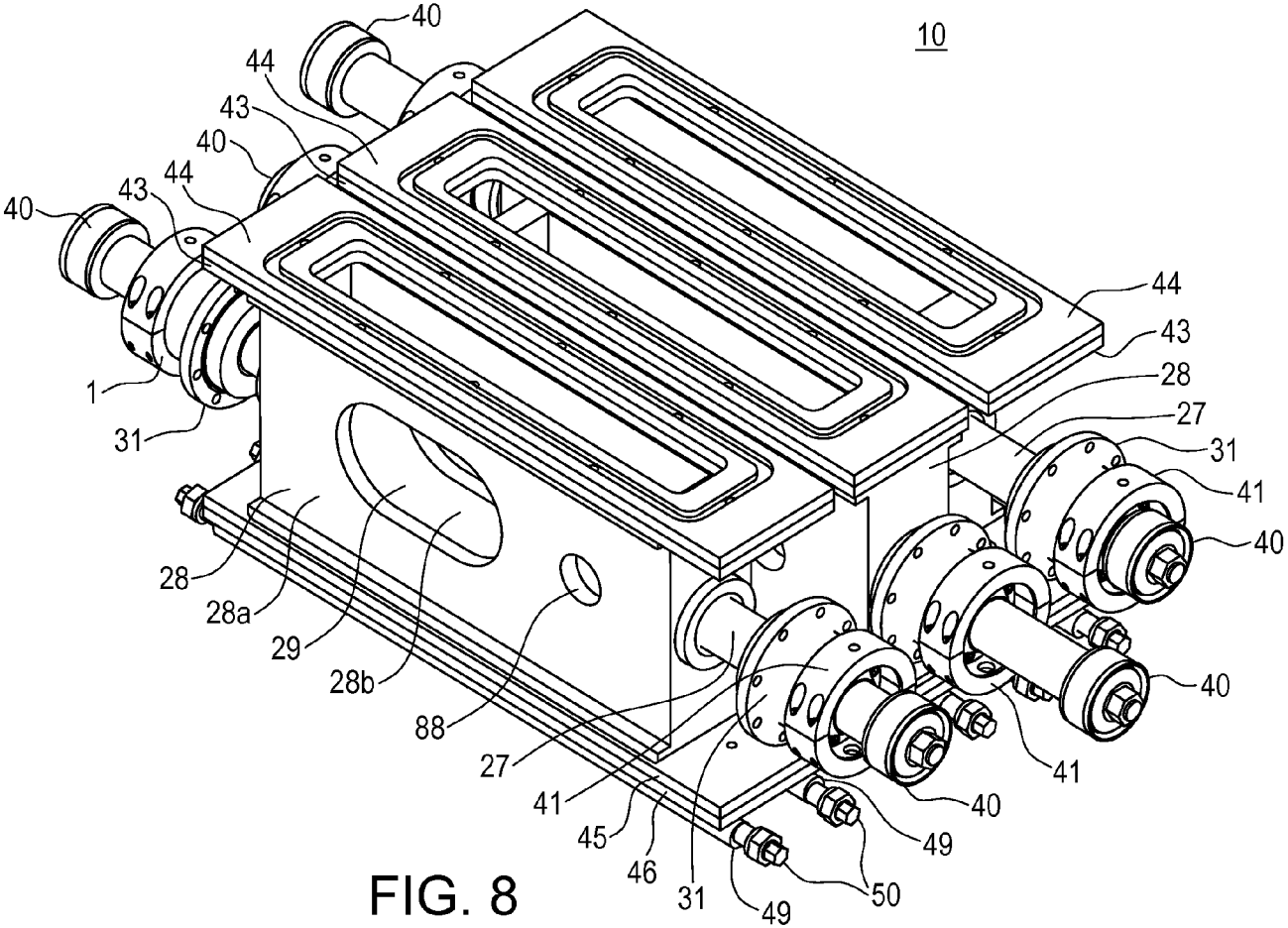
FIG. 8 is a perspective sectional view of the mud pump of FIG. 7 with the frame removed.
Figure 9:
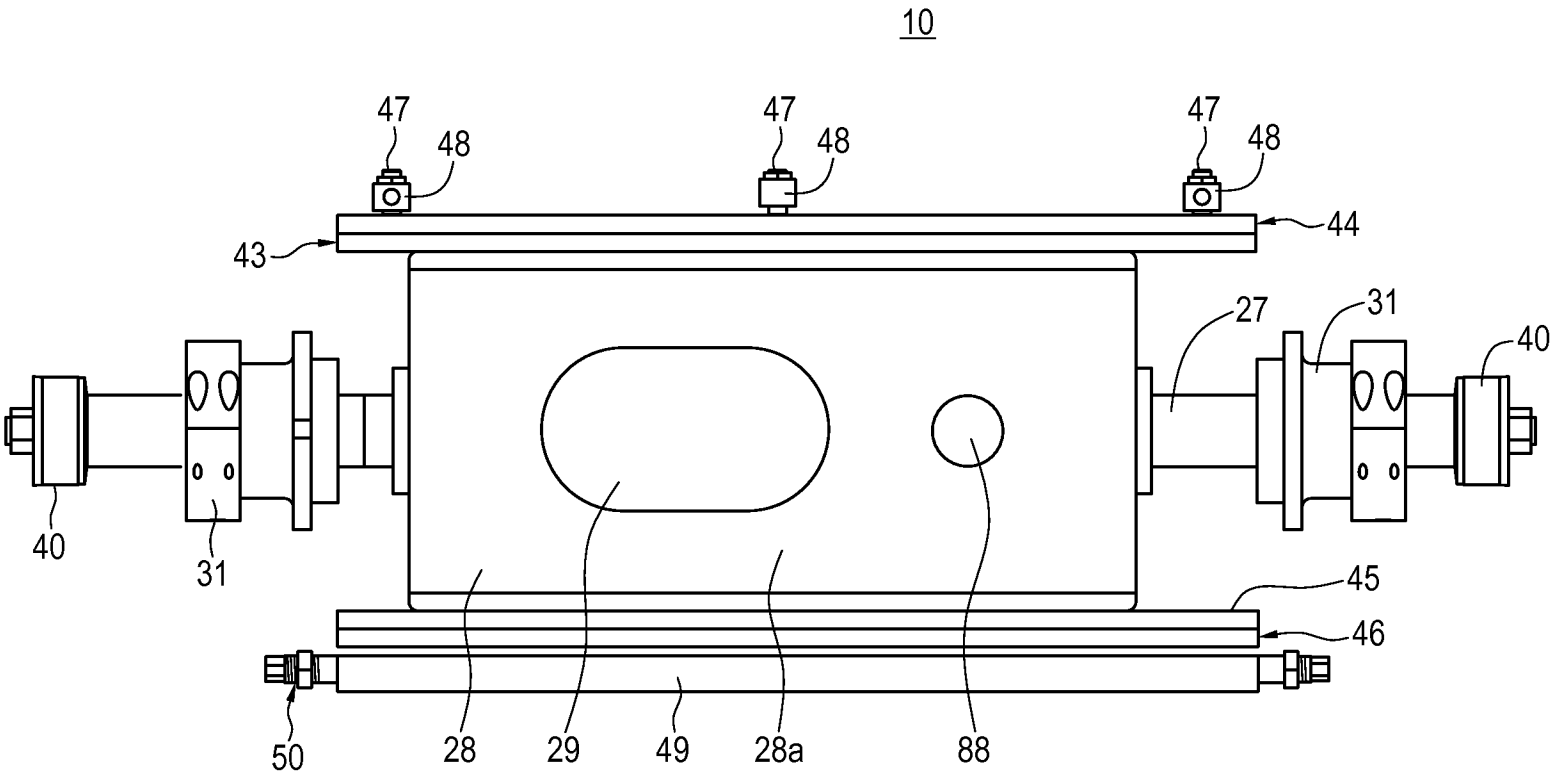
FIG. 9 is a front elevation view of the mud pump of FIG. 8.

Referring to FIGS. 5 and 6, front cross-section views of mud pump 10 are shown revealing the internal components of the embodiment shown therein. In this embodiment, pump shaft 30 rotates as a result of input rotational power applied to input shaft 12 that is operatively coupled to pump shaft 30 via transmission 22 as shown in FIG. 4. In one embodiment, pump shaft 30 can comprise eccentric 80 disposed thereon and affixed thereto with pin 82. Rotatably disposed on eccentric 80 is connecting rod 84. In another embodiment, eccentric bearing 83 is disposed between eccentric 80 and connecting rod 84. In a further embodiment, connecting rod 84 is rotatably pinned to sidewall 28*b* (and sidewall 28*a* as shown in FIGS. 8 and 9) of slide 28 via pin 86. In yet another embodiment, bearing 85 can be disposed between pin 86 and connecting rod 84. In FIG. 5, eccentric 80 is shown rotating clockwise thereby moving connecting rod 84 upwards and to the right in this figure. In so doing, slide 28 is being pushed to the right. In one embodiment, slide 28 is disposed between upper support plate 44 and lower support plate 46 to help keep slide 28 moving in a horizontal linear path, and to resist the bending moment caused by the rotation of pump shaft 30 and eccentric 80. In another embodiment, upper slide bearing 43 can be disposed between upper plate 44 and slide 28, and lower slide bearing 45 can be disposed between lower plate 46 and slide 28 as a means to reduce the friction between slide 28 and upper and lower plates 44 and 46 as slide 28 moves side-to-side.

As slide 28 moves to the right, it pushes piston rod 27*a* and, hence, piston 40*a* to the right in liner 26*a* to push fluids in pump chamber 42*a* out through valve 39*ao* to outlet ports 35 (not shown) and outlet manifold 58 (not shown). In so doing, piston rod 27*b* also pulls piston 40*b* in liner 26*b* to the right thereby drawing in fluid through valve 39*bi* from intake manifold 52.

In FIG. 6, eccentric 80 is shown rotated further clockwise (from FIG. 5) thereby moving connecting rod 84 downward and to the left. In so doing, piston 40*a* is being pulled to the left thereby drawing in fluid into pump chamber 42*a* through valve 39*ai* from intake manifold 52 while piston 40*b* is pushed to the left thereby pushing fluid out of pump chamber 42*b* through valve 39*bo* to outlet ports 35 (not shown) and outlet manifold 58 (not shown). In this figure, the connecting rods 84 of two adjacent stages rising above the top of frame 18.

Figure 7:
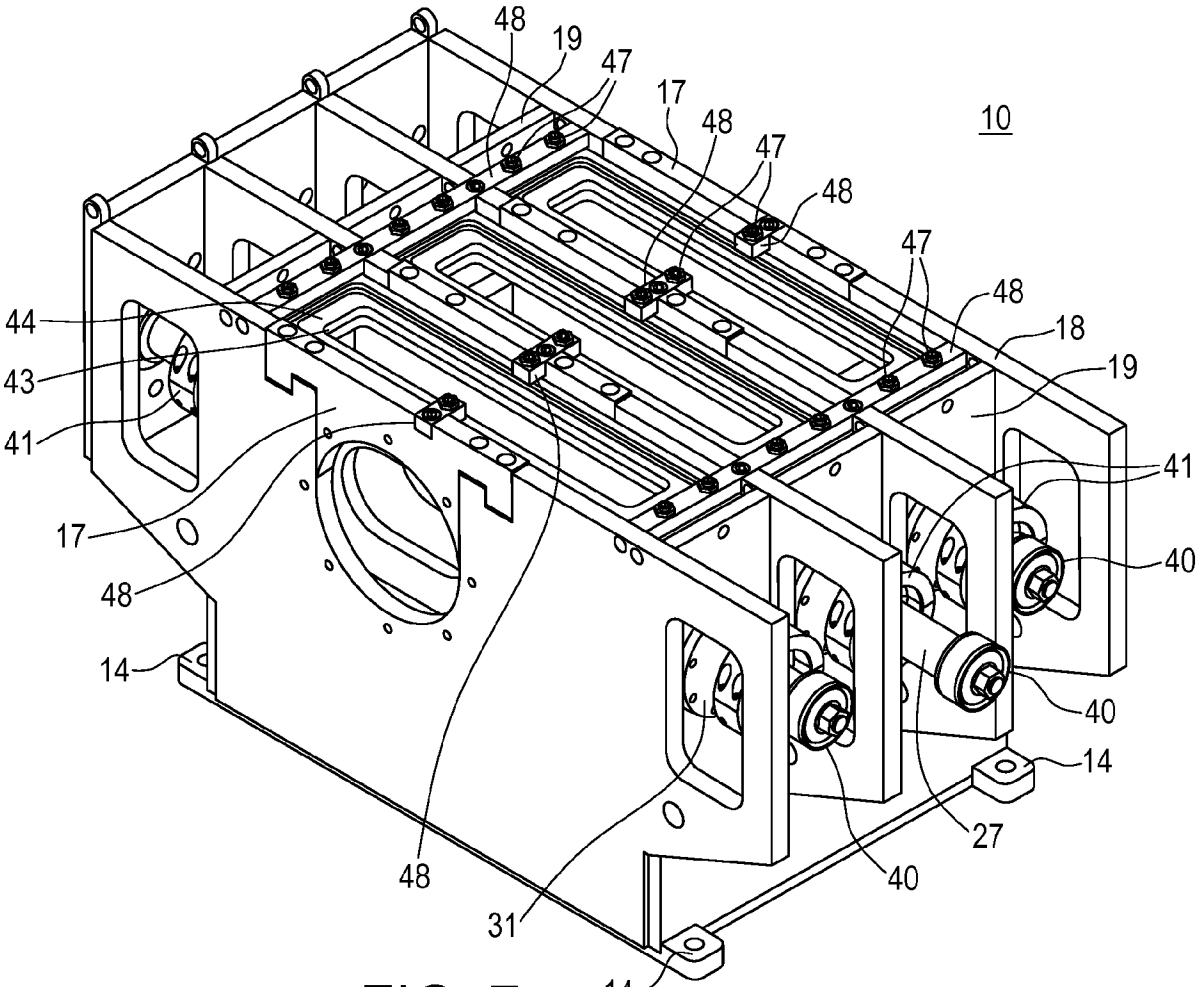
FIG. 7 is a perspective view depicting the frame of the mud pump of FIG. 1 showing only the slides, the slide bearings, the slide bearing support plates and the piston assemblies.

Referring to FIG. 7, mud pump 10 is shown without pump modules 24, cover 22, piston liners 26, pump shaft 30, slides 28 and connecting rods 84. In this illustrated embodiment, frame sidewalls 19 are visible as are removable caps 17, which are configured hold pump shaft 30 in place in frame 18. Also visible are piston rods 27, rod support bushings 31, couplers 41 and pistons 40. In one embodiment, mud pump 10 can comprise means for applying a loading force to upper support plates 44 to keep slide 28 confined to a horizontally linear range of motions. In some embodiments, these means can comprise a plurality of setscrew rails 48 disposed on frame 18 near sidewalls 19 and disposed on caps 17. In further embodiments, setscrew rails 48 can comprise a plurality of setscrews 47 threadably attached to and through said setscrew rails. Setscrews 47 can be tightened to apply forces to various locations on upper support plates 44 whereby the loading force applied to upper support plates can be adjusted at each location of setscrews 47 to ensure that slide 28 is constrained to horizontal linear movement. While the illustrated embodiment shows setscrews 47 as being manually adjustable for applying force to slide 28, it is obvious to those skilled in the art that mud pump 10 can comprise further means for monitoring the movement of slides 28 and for automatically adjusting setscrews 47 with electro-mechanical servo motors, or the like, so that setscrews 47 are dynamically adjusted in real-time to ensure that proper force is being applied to slide 28 at all times to keep its movement linearly horizontal.

Figure 10:
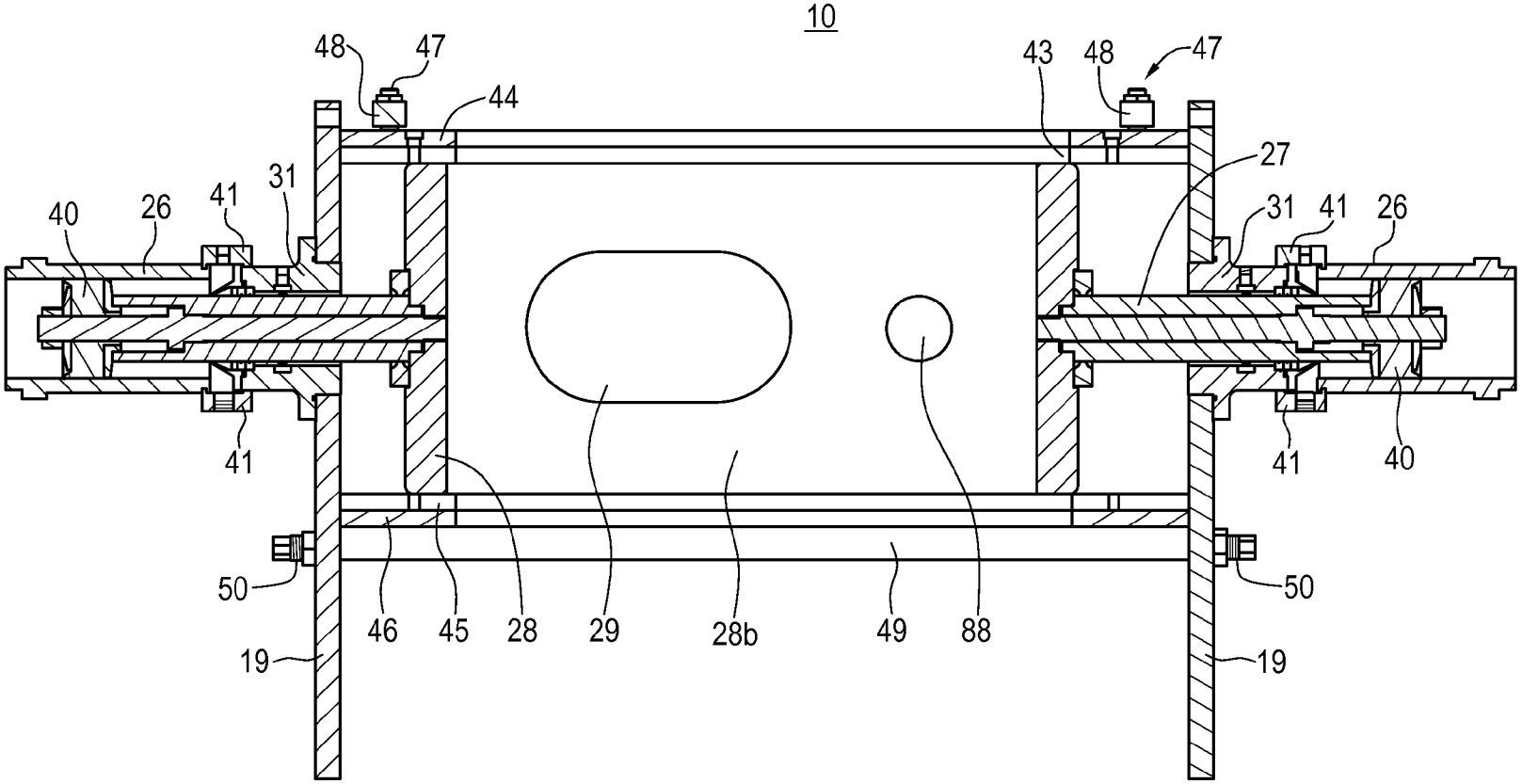
FIG. 10 is a front cross-sectional view of the mud pump of FIG. 7.
Figure 12:
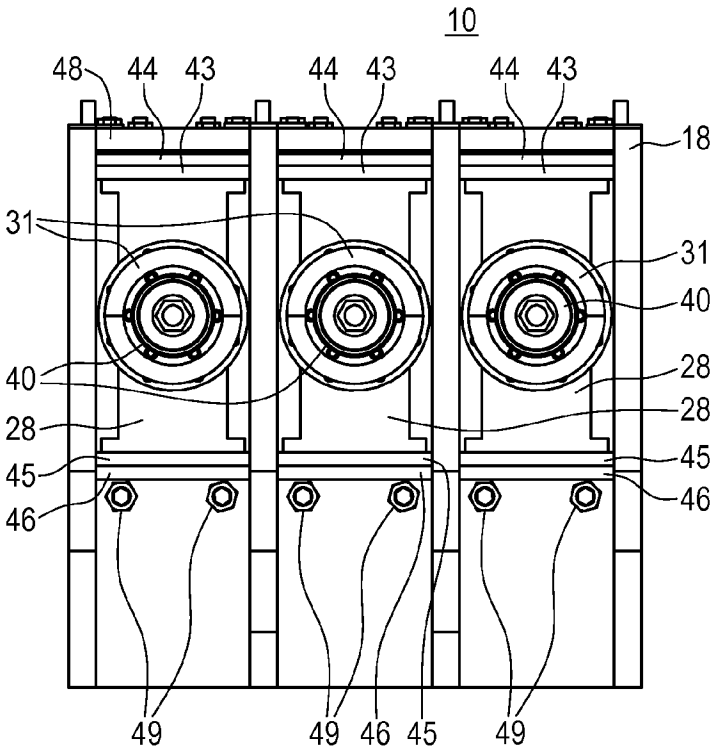
FIG. 12 is a side elevation view depicting the mud pump of FIG. 11 with the pump module mounting plate removed.
Figure 11:
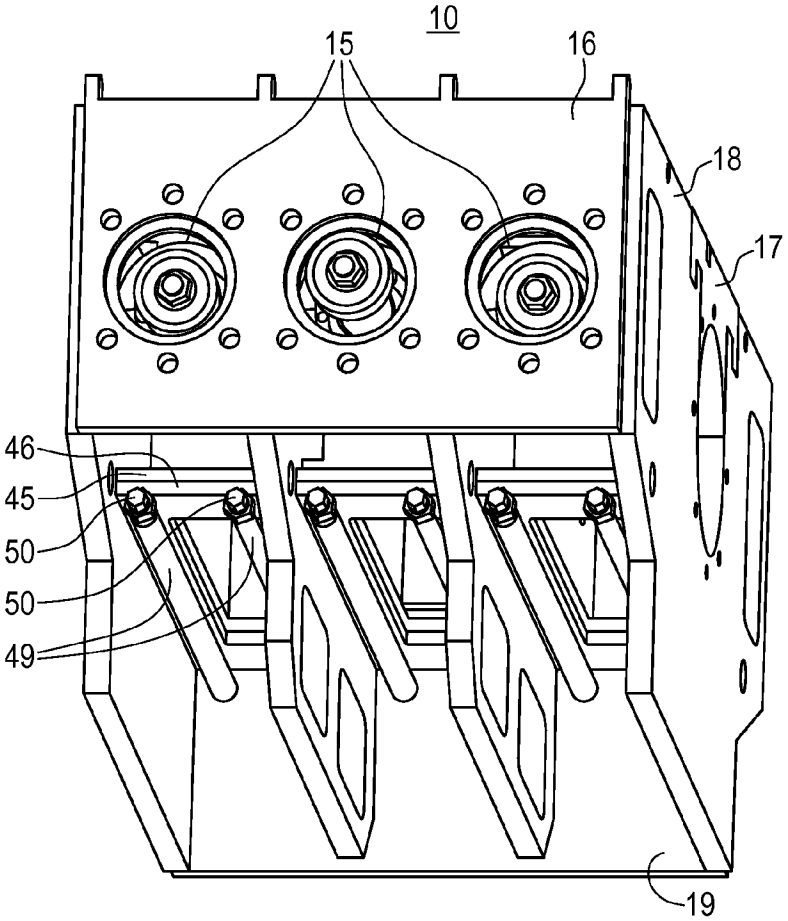
FIG. 11 is a side perspective view depicting the mud pump of FIG. 7.

Referring to FIG. 8, the mud pump 10 of FIG. 7 is now shown with frame 18 removed to reveal slides 28. In some embodiments, each slide 28 can comprise a pair of substantially parallel spaced-apart sidewalls 28*a* and 28*b*, as shown in FIGS. 8, 9 and 10. In this embodiment, slides 28 can comprise openings 29 disposed through sidewalls 28*a* and 28*b* for pump shaft 30 (not shown) to pass through and pin openings 88 disposed through sidewalls 28*a* and 28*b* that are configured to receive connecting rod pins 86 (not shown). In some embodiments, mud pump 10 can further comprise one or more eccentric rods 49 disposed beneath lower support plates 46 for applying upwards force thereto for ensuring that slide 28 is constrained to horizontal linear movement. This is also shown in FIGS. 9, 10, 11 and 12. In some embodiments, eccentric rods 49 can be rotated or adjusted and then set into position by turning rod adjusters 50. While the illustrated embodiment shows eccentric rods 49 as being manually adjustable for applying force to slide 28, it is obvious to those skilled in the art that mud pump 10 can comprise further means for monitoring the movement of slides 28 and for automatically adjusting eccentric rods 49 with electro-mechanical servo motors, or the like, operatively coupled to rod adjusters 50 so that eccentric rods 49 are dynamically adjusted in real-time to ensure that proper force is being applied to slide 28 at all times to keep its movement linearly horizontal.

Referring to FIG. 13, a cross-section view is shown of the internal pumping mechanism of mud pump 10. In some embodiments, piston rod 27 can be coupled to slide 28 by threading piston rod 27 into threaded opening 91 disposed on slide 28. In other embodiments, piston rod 27 can be further secured with lock nut 101 threaded on piston rod 27 and tightened against slide 28. In yet further embodiments, piston rod stud 92 can be disposed in an opening disposed through piston rod 27 and secured to slide 28 in threaded opening 93. In some embodiments, piston rod stud 92 can further comprise flange 95 that can rest against shoulder 94 disposed within piston rod 27. Piston rod stud 92 can also serve as means for mounting piston 40 and piston retaining caps 96 and 97 thereon. Nut 98 can be used to secure piston 40 and caps 96 and 97 on piston rod stud 92.

In some embodiments, mud pump 10 can comprise means for circulating coolant in piston liner 26 behind piston 40 to prevent overheating of the mechanism when in operation. As shown in FIG. 13, coolant can be pumped by coolant pump 34 (as shown in FIG. 4) into liner chamber 106 through coolant inlet 102 via lines, hoses or piping (not shown). Coolant can the flow through, and circulate within, chamber 106 and then exit through coolant outlet 104. Lines, hoses and piping (not shown) can be coupled to outlet 104 so that the heated coolant can be collected, cooled and re-circulated. In other embodiments, inlet 102 and outlet 104 can further comprise one-way valves, such as ball-valves as one example obvious to those skilled in the art, such that coolant can be drawn into chamber 106 through inlet 102 as piston 40 is moving towards pump module 24 (not shown), and then expelled from chamber 106 through outlet 104 and piston 40 is moving away from pump module 24.

In some embodiments, mud pump 10 can comprise means for circulating lubricating oil to piston rod 27 as it reciprocates back and forth through support bushing 31. As shown in FIG. 13, lubricating oil can be pumped by oil pump 32 (as shown in FIG. 4) into oil inlet 108 where it can flow into annulus 110 between piston rod 27 and support bushing 31 thereby maintaining a layer of lubricating oil therebetween. Oil can then flow out of annulus 110 into galleys 38 (as shown in FIG. 1) where the oil can be collected and re-circulated. In other embodiments, barrier seals 99 and ice-breaker wear band 100 can be disposed between piston rod 27 and support bushing 31 as sealing means to separate and isolate chamber 106 from annulus 110 so that coolant does not intermingle with and contaminate the lubricating oil, and vice-versa.

In the embodiments illustrated the figures herein, there are three slides 28 shown, each coupled to two pump modules 24 thereby resulting in the operation of six pump modules. It is obvious to those skilled in the art that fewer or more slides mechanisms can be implemented to either decrease or increase the number of pump modules that can be operated. It is also obvious to those skilled in the art that a slide frame can be releasably coupled to a single piston rod to, therefore, operate a single pump module.

Referring to FIG. 6, pump shaft 30 is shown turning three connecting rods 84. This necessarily requires pump shaft 30 having three eccentric lobes 80. In this configuration, the lobes can be displaced nominally 120° apart from each other such that the lobes can be substantially spaced equally apart around the circumference of pump shaft 30. In embodiments where pump shaft 30 comprises two eccentric lobes 80, the lobes can be displaced nominally 180° apart. In other embodiments where pump shaft 30 comprises two lobes 80, one lobe 80 can be displaced 178° from the other lobe 80 so that pump shaft 30 can more easily turn from a dead stop. In other embodiments where additional eccentric lobes are disposed on pump shaft 30, the lobes can be substantially spaced equally apart on pump shaft 30. For example, for a four-lobe shaft, each lobe 80 can be displaced 90° nominally from each other lobe 80. If five lobes are disposed on pump shaft 30, the lobes can be displaced nominally 72° apart on pump shaft 30. For six lobes disposed on pump shaft 30, the lobes can be displaced nominally 60° apart, and so on.

In operation, mud can be supplied to inlet 54 on intake manifold 52 from an external pump (not shown) drawing mud from a mud tank (not shown) as well known to those skilled in the art. As slides 28 operate pump modules 24, mud is drawn into pump modules 24 from intake manifold 52 and pumped out of pump modules 24 into outlet manifold 58 via outlet manifold couplers 62 disposed between pump modules 24 and outlet manifold 58. The pumped mud can exit outlet manifold 58 via outlet 60 that can be connected to a mud delivery pipe and/or hose for use on a drilling rig (not shown) as well known to those skilled in the art. In one embodiment, the diameter of inlet 54 and the pipe that make up intake manifold 52 can be nominally ten inches whereas the diameter of outlet and the pipe that make up outlet manifold 58 can be nominally four inches. In another embodiment, outlet manifold 58 can comprise couplings (not shown) for connection with a pressure gauge to provide a visual indication of the pressure of the mud being pumped and/or a pressure relief valve to provide means to limit the pressure of the mud being pumped by mud pump 50. It is obvious to those skilled in the art that the diameters of inlet 54, intake manifold 52, outlet manifold 58 or outlet 60 can be increased or decreased depending on the volume and pressure of drilling mud required in the drilling of a well.

In operation, it is expected that mud pump 10 can operate up to 65 revolutions per minute using a 1000 horsepower motor, which translates up to 130 pump module strokes per minute per slide frame mechanism given that each slide frame can be coupled to two pump modules. It is also anticipated that mud pump 10 can pump up to 800 gallons or 4 cubic meters of drilling mud per minute. Using 7-inch liners in the pump modules, it is expected that mud pump 10 can pump mud up to 1500 pounds per square inch in pressure. It is also expected that mud pump 10 would weigh approximately 45,000 pounds and deliver the equivalent volume and pressure of drilling mud as a conventional mud pump powered by a 1600 horsepower motor weighing up to 120,000 pounds.

Figure 14:
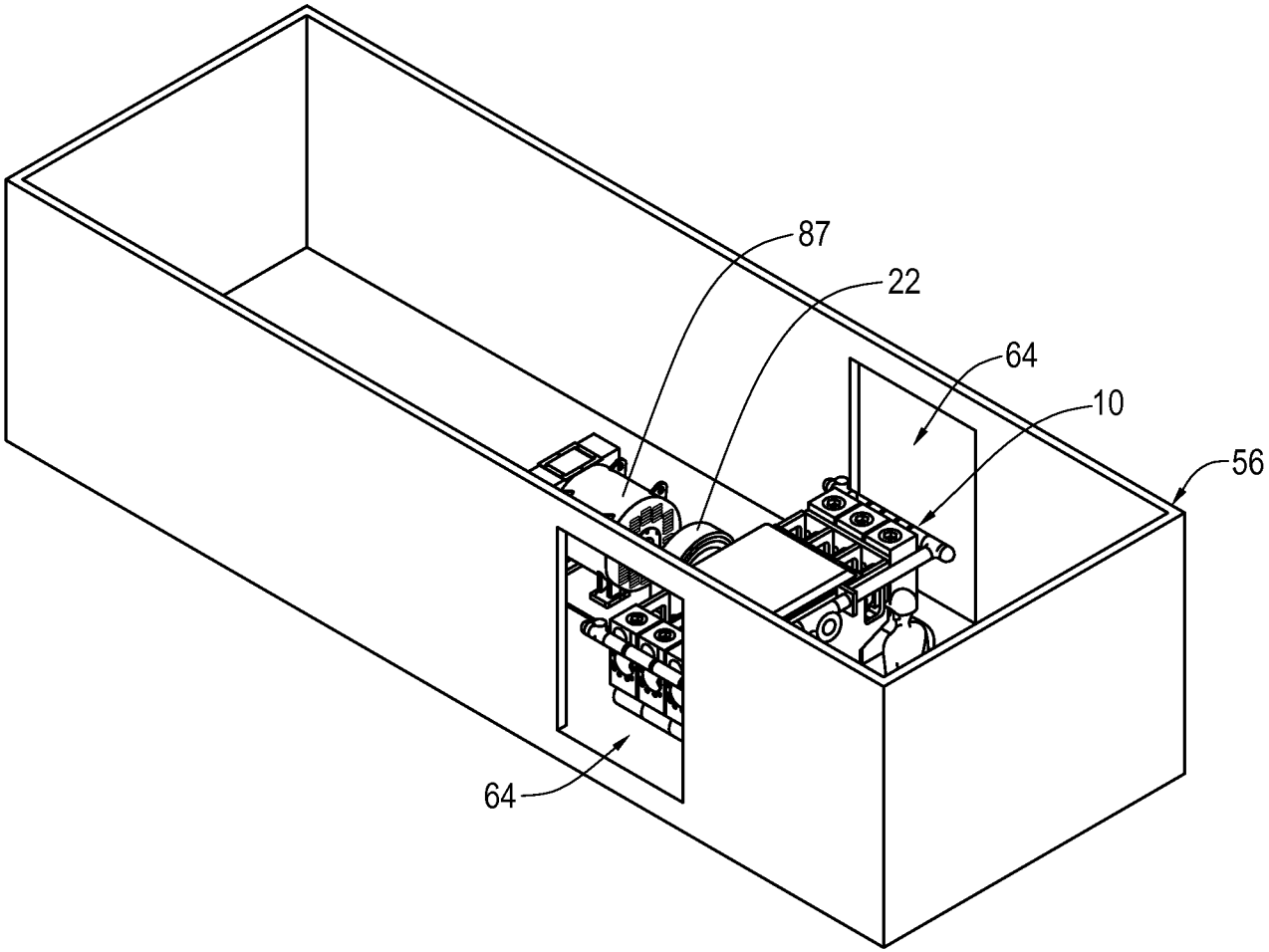
FIG. 14 is a perspective view depicting the mud pump of FIG. 1 installed in a pump house.
Figure 15:
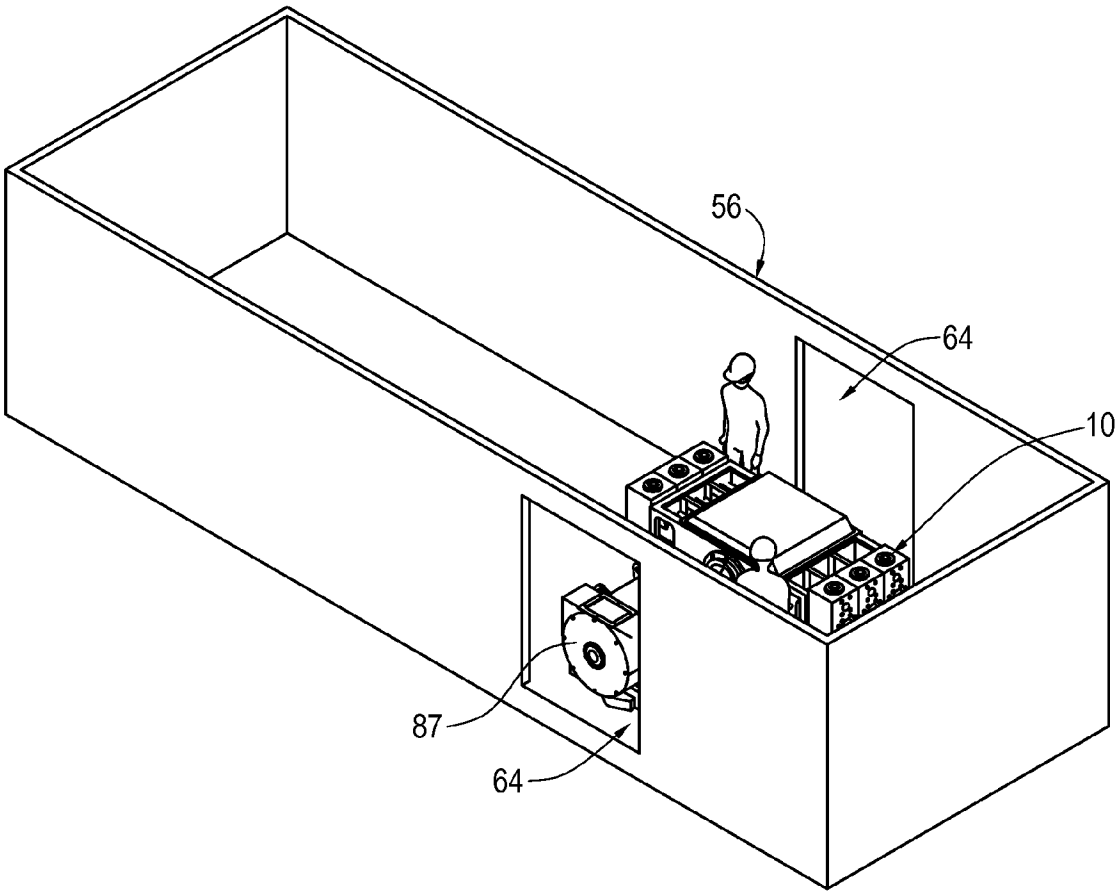
FIG. 15 is a perspective view depicting the mud pump of FIG. 1 installed in a pump house.

Referring to FIG. 14, mud pump 10 is shown positioned in pump house 56, a structure used to house mud pumps at drilling sites. Access to mud pump 10 is done through doorways 64. In this configuration, mud pump 10, with electric motor 87 coupled to mud pump 10 via transmission 22, is positioned "lengthwise" in pump house 56. Referring to FIG. 15, the combination of mud pump 10 and motor 87 is shown in pump house 56 rotated 90 degrees. The compactness of mud pump 10 can allow it to be installed in this manner in pump house 56 whereby access to the inlet and outlet to mud pump 10 is through doorway 64. In addition, more than one mud pump 10 can be installed in pump house 56 thereby reducing the number of pump houses required at a drilling site if the well being drilled requires a volume of pressurized drilling mud greater than what one mud pump 50 can provide.

Although a few embodiments have been shown and described, it will be appreciated by those skilled in the art that various changes and modifications might be made without departing from the scope of the invention. The terms and expressions used in the preceding specification have been used herein as terms of description and not of limitation, and there is no intention in the use of such terms and expressions of excluding equivalents of the features shown and described or portions thereof, it being recognized that the invention is defined and limited only by the claims that follow.

What is claimed is:

1. A mud pump, comprising:

a frame;

at least one pump module disposed on the frame, the at least one pump module comprising an inlet port and an outlet port;

a pump shaft rotatably disposed in the frame for receiving rotational power from a motor, the pump shaft having at least one substantially circular eccentric lobe disposed thereon, the centre of the at least one eccentric lobe displaced or offset from the longitudinal axis of the pump shaft;

at least one slide disposed in the frame, the at least one slide operatively configured to move linearly side-to-side within the frame, the at least one slide further comprising a pair of substantially parallel spaced-apart sidewalls;

at least one piston rod assembly operatively coupling the at least one slide to the at least one pump module; and a connecting rod comprising first and second ends operatively coupling the pump shaft to the at least one slide, the connecting rod disposed between the sidewalls of the at least one slide such that the connecting rod is pivotable relative to the sidewalls, the first end rotatably disposed on the at least one eccentric lobe, the second end rotatably pinned to both sidewalls of the at least one slide whereby rotation of the pump shaft causes the slide to move side-to-side that, in turn, causes the at least one piston rod assembly to operate the at least one pump module.

2. The mud pump as set forth in claim 1 further comprising a transmission operatively disposed between the motor and the pump shaft thereby coupling the motor to the pump shaft.

3. The mud pump as set forth in claim 2, wherein the transmission further comprises a single-stage or a dual-stage gear transmission.

4. The mud pump as set forth in claim 1, wherein the motor comprises a 3-phase alternating current electric motor.

5. The mud pump as set forth in claim 1, further comprising an intake manifold operatively coupled to the inlet port of the at least one pump module, the intake manifold providing communication between an intake manifold inlet and the inlet port of the at least one pump module.

6. The mud pump as set forth in claim 1, further comprising an outlet manifold operatively coupled to the outlet port of the at least one pump module, the outlet manifold providing communication between the outlet port of the at least one pump module and an outlet manifold outlet.

7. The mud pump as set forth in claim 1, further comprising upper and lower support plates operatively coupled to the frame, the support plates configured to constrain the at least one slide to horizontal and linear movement.

8. The mud pump as set forth in claim 7, further comprising at least one slide bearing disposed between the slide and one or both of the upper and lower support plates.

9. The mud pump as set forth in claim 8, further comprising means for applying a loading force on one or both of the upper and lower support plates.

10. The mud pump as set forth in claim 1, wherein the at least one piston rod assembly further comprises:

a piston rod support bushing configured to be disposed on the frame;

a piston liner comprising first and second ends, the first end operatively coupled to the piston rod support bushing, the second end operatively coupled to the at least one pump module; and a piston rod slidably disposed in the support bushing, the piston rod comprising first and second ends, the first end operatively coupled to the at least one slide, the second end further comprising a piston slidably disposed in the piston liner thereby forming a liner chamber disposed between the piston and the support bushing.

11. The mud pump as set forth in claim 10, wherein the piston rod support bushing further comprises means for circulating coolant and lubricant through the liner chamber.

12. The mud pump as set forth in claim 10, wherein the piston rod support bushing further comprises means for lubricating the piston rod.

13. The mud pump as set forth in claim 11, wherein the piston rod support bushing further comprises means for lubricating the piston rod.

14. The mud pump as set forth in claim 1, further comprising a pump house wherein the mud pump is disposed in the pump house.

15. A mud pump, comprising:

a platform;

a lattice frame disposed on the platform;

at least one pump module disposed on the frame, the at least one pump module comprising an inlet port and an outlet port;

a pump shaft rotatably disposed in the frame for receiving rotational power, the pump shaft having at least one substantially circular eccentric lobe disposed thereon, the centre of the at least one eccentric lobe displaced or offset from the longitudinal axis of the pump shaft;

a motor operatively coupled to the pump shaft, the motor disposed on the platform;

at least one slide disposed in the frame, the at least one slide operatively configured to move linearly side-to-side within the frame, the at least one slide further comprising a pair of substantially parallel spaced-apart sidewalls;

at least one piston rod assembly operatively coupling the at least one slide to the at least one pump module; and a connecting rod comprising first and second ends operatively coupling the pump shaft to the at least one slide, the connecting rod disposed between the sidewalls of the at least one slide such that the connecting rod is pivotable relative to the sidewalls, the first end rotatably disposed on the at least one eccentric lobe, the second end rotatably pinned to both sidewalls of the at least one slide whereby rotation of the pump shaft causes the slide to move side-to-side that, in turn, causes the at least one piston rod assembly to operate the at least one pump module.

16. The mud pump as set forth in claim 15, further comprising a transmission operatively disposed between the motor and the pump shaft thereby coupling the motor to the pump shaft.

17. The mud pump as set forth in claim 16, wherein the transmission further comprises a single-stage or a dual-stage gear transmission.

18. The mud pump as set forth in claim 15, wherein the motor comprises a 3-phase alternating current electric motor.

19. The mud pump as set forth in claim 15, further comprising an intake manifold operatively coupled to the inlet port of the at least one pump module, the intake manifold providing communication between an intake manifold inlet and the inlet port of the at least one pump module.

20. The mud pump as set forth in claim 15, further comprising an outlet manifold operatively coupled to the outlet port of the at least one pump module, the outlet manifold providing communication between the outlet port of the at least one pump module and an outlet manifold outlet.

21. The mud pump as set forth in claim 15, further comprising upper and lower support plates operatively coupled to the frame, the support plates configured to constrain the at least one slide to horizontal and linear movement.

22. The mud pump as set forth in claim 21, further comprising at least one slide bearing disposed between the slide and one or both of the upper and lower support plates.

23. The mud pump as set forth in claim 22, further comprising means for applying a loading force on one or both of the upper and lower support plates.

24. The mud pump as set forth in claim 15, wherein the at least one piston rod assembly further comprises:

a piston rod support bushing configured to be disposed on the frame;

a piston liner comprising first and second ends, the first end operatively coupled to the piston rod support bushing, the second end operatively coupled to the at least one pump module; and a piston rod slidably disposed in the support bushing, the piston rod comprising first and second ends, the first end operatively coupled to the at least one slide, the second end further comprising a piston slidably disposed in the piston liner thereby forming a liner chamber disposed between the piston and the support bushing.

25. The mud pump as set forth in claim 24, wherein the piston rod support bushing further comprises means for circulating coolant and lubricant through the liner chamber.

26. The mud pump as set forth in claim 24, wherein the piston rod support bushing further comprises means for lubricating the piston rod.

27. The mud pump as set forth in claim 25, wherein the piston rod support bushing further comprises means for lubricating the piston rod.

28. The mud pump as set forth in claim 15, further comprising a pump house wherein the mud pump is disposed in the pump house.

* * * * *